United States Patent [19]

Suzuki

[11] Patent Number: 5,068,506

[45] Date of Patent: Nov. 26, 1991

[54] SWITCH HAVING A LOCKING MECHANISM

[75] Inventor: Akira Suzuki, Aichi, Japan

[73] Assignee: Kabushiki Kaisha Tokai Rika Denki Seisakusho, Aichi, Japan

[21] Appl. No.: 642,549

[22] Filed: Jan. 18, 1991

Related U.S. Application Data

[63] Continuation of Ser. No. 381,250, Jul. 18, 1989, abandoned.

[30] Foreign Application Priority Data

Jul. 28, 1988 [JP] Japan ..... 63-100804

[51] Int. Cl.[5] ..... H01H 13/58; H01H 19/62

[52] U.S. Cl. ..... 200/526; 200/528; 200/531; 200/336

[58] Field of Search ..... 200/524, 526, 527, 528, 200/531, 336

[56] References Cited

U.S. PATENT DOCUMENTS

| | | | |
|---|---|---|---|
| 1,285,072 | 11/1918 | Douglas | 200/526 |
| 1,732,577 | 10/1929 | Durdin, Jr. | 200/526 |
| 3,223,072 | 12/1965 | Bross | 200/526 |
| 3,523,168 | 8/1970 | Holmes | 200/526 |
| 4,319,106 | 3/1982 | Armitage | 200/526 |
| 4,506,124 | 3/1985 | Rose et al. | 200/528 |

FOREIGN PATENT DOCUMENTS

| | | | |
|---|---|---|---|
| 222708 | 8/1962 | Austria | 200/526 |
| 1362299 | 4/1964 | France | 200/526 |

*Primary Examiner*—Henry J. Recla
*Assistant Examiner*—Keith Kupferschmid
*Attorney, Agent, or Firm*—Finnegan, Henderson, Farabow, Garrett and Dunner

[57] ABSTRACT

A switch includes a casing in which a contact holder is movably provided allowing the holder to move from an original position into a pressed in position in response to the pressing of a button. The contact holder is biased toward the original position by a spring. A rotor is provided on either the fixed casing or the movable contact holder such that the rotor is rotatable about an axis parallel with the direction of movement of the contact holder. The outside circumferential surface of the rotor has a cam groove which has oblique parts and locking halfway parts. A locking projection is provided on either the contact holder or the casing, and the locking projection is fitted in the cam groove so that the projection slides relating to the groove as the holder is moved, thereby rotating the rotor. A contact on the contact holder selectively engages a contact on the casing, depending on whether the holder is in the original or the pressed in position.

16 Claims, 3 Drawing Sheets

SWITCH HAVING A LOCKING MECHANISM

This application is a continuation of application Ser. No. 07/381,250 filed July 18, 1989; now abandoned.

FIELD OF THE INVENTION

The present invention relates to a switch having a locking mechanism for locking a contact holder in a pressed-in position and unlocking the holder out of the position

BACKGROUND OF THE INVENTION

A conventional switch of the type of being pressed to be turned on or off has a locking mechanism for locking a contact holder in a pressed-in position and unlocking the holder out of the position.

The locking mechanism is constituted by a heart-shaped cam groove provided in the side of the contact holder, and a locking pin supported at a bottom portion thereof by the casing of the switch and fitted at a tip of the pin in the cam groove so that the pin slide in the cam groove relative to the contact holder as the holder is moved. The tip of the locking pin is urged to the bottom or one side of the cam groove by a spring.

When the contact holder is pressed out of the original position thereof, the tip of the locking pin slides in the cam groove. When the pressing of the contact holder is ceased, the tip of the locking pin is engaged into the locking part of the cam groove so that the contact holder is locked in the pressed-in position thereof. When the contact holder is pressed again, the tip of the locking pin slides in the cam groove and is disengaged out of the locking part thereof. When the latter pressing of the contact holder is ceased, the holder is returned to its original position along with the sliding of the tip of the locking pin in the cam groove.

Since the tip of the locking pin of the conventional switch is always urged to the cam groove by the spring, the resistance to the sliding of the pin in the cam groove is so high that the manipulating property of the switch is low. This is a problem. Further, a collision noise would be generated when the tip of the locking pin falls down the stepped portion of the cam groove. This is another problem.

SUMMARY OF THE INVENTION

The present invention was made in order to solve the problems. Accordingly, it is an object of the present invention to provide a switch having a locking mechanism manipulating property of which is improved and in which the collision noise of the prior art is not would not be generated.

The switch provided in accordance with the present invention comprises a casing, a contact holder, a biasing means, a rotor, a locking projection and a switching means. The contact holder is movably provided in the casing so that the holder is moved into the pressed-in position thereof by pressing manipulation. The contact holder is biased toward the original position thereof by the biasing means. The rotor is provided on one of the casing, which is not movable, and the contact holder, which is movable, so that the rotor is rotated about an axis parallel with the direction of movement of the contact holder. The outside circumferential surface of the rotor has a cam groove which has oblique parts and locking halfway parts. The locking projection is provided on the other of the casing and the contact holder, and the locking projection is fitted in the cam groove so that the projection slides in the groove relative to the rotor as the holder is moved. The state of the switching means is changed as the contact holder is moved.

When the contact holder is pressed inward out of the original position thereof into the pressed-in position thereof, the locking projection slides in the oblique part of the cam groove so that the rotor is rotated. When the pressing of the contact holder is ceased, the holder is moved toward the original position thereof by the biasing means and the locking projection is engaged into the locking halfway part of the cam groove so that the holder is locked in the pressed-in position thereof. When the contact holder is pressed inward out of the pressed-in position thereof, the locking projection is disengaged out of the locking halfway part of the cam groove and slides in the oblique part thereof so that the rotor is rotated. When the latter pressing of the contact holder is ceased, the holder is moved back into the original position thereof so that the rotor is rotated.

Since the locking projection of the switch provided in accordance with the present invention does not need to be biased to the cam groove but slidable therein, the resistance to the sliding of the locking projection in the cam groove is reduced relative to that in the conventional switch in which the tip of the locking pin is biased toward the cam groove. Since the tip of the locking projection does not need to be biased to the cam groove and the bottom of the groove is smooth, the collision noise of the prior art is not produced by the locking projection in the cam groove.

DESCRIPTION OF THE PREFERRED EMBODIMENTS

Preferred embodiments of the present invention are hereinafter described in detail with reference to accompanying drawings.

Figure 1:
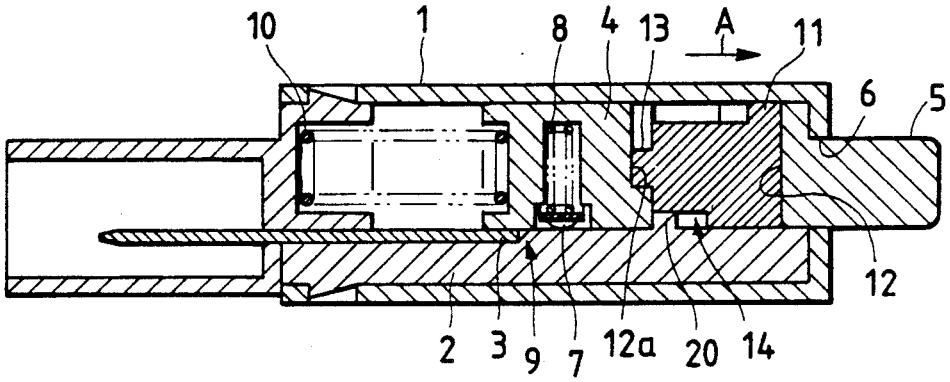
FIG. 1 is a longitudinally sectional view of the switch of a first embodiment of the present invention in the state that a contact holder is in its original position.
Figure 2:
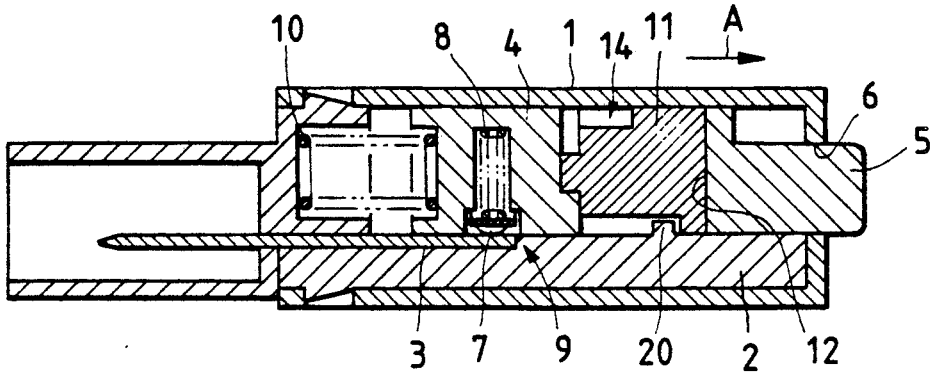
FIG. 2 is a longitudinally sectional view of the switch shown in FIG. 1 in the state that the contact holder is in the pressed-in position.

FIGS. 1 to 4 show a switch which is a first embodiment of the invention. The switch comprises a rectangular casing 1, an electric insulator 2, a fixed contact 3, a contact holder 4, a manipulating portion 5, a movable contact 7, a spring 8, a switching means 9, a biasing means 10, and a rotor 11. As can be seen in FIGS. 1 and 2, the holding means 4 and the manipulating portion 5 consist of one-piece with a chamber 12 therein. The rotor 11 fits into the chamber 12.

The electric insulator 2 is mounted in the lower portion of the casing 1. The fixed contact 3 is provided on the top of the insulator 2 in the casing 1. The contact holder 4 is provided in the casing 1 and movable rightward and leftward with respect to FIGS. 1 and 2. The manipulating portion 5 is provided on the right-hand end of the contact holder 4 integrally therewith, and projects rightward through a hole 6 of the casing 1. The movable contact 7 is provided on the contact holder 4 and urged downward by the spring 8 so that the movable contact slides into or out of touch with the fixed contact 3, on the insulator 2, along with the movement of the holder 4.

Figure 3:
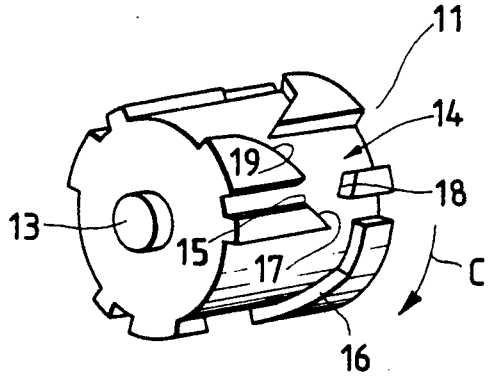
FIG. 3 is a perspective view of the rotor of the switch shown in FIGS. 1 and 2.

The fixed and the movable contacts 3 and 7 constitute the switching means 9. The biasing means 10 is made of a compressed helical spring which is a return spring provided between the insulator 2 and the contact holder 4 in the casing 1 and urges the holder 4 in a direction A to return the holder into the original position thereof. The holding means 4 and the manipulating portion 5 consist of one-piece with a chamber 12 therein. The rotor 11 is provided in the chamber 12 of the contact holder 4, and formed with a boss 13 integrally with the left-hand end of the rotor as shown in FIGS. 1 and 3. The boss 13 is rotatably supported in the notch 12*a* of the chamber 12 so that the boss 13 and the rotor 11 can be rotated together about their common axis, which is parallel with the direction of the movement of the contact holder 4.

Figure 4:
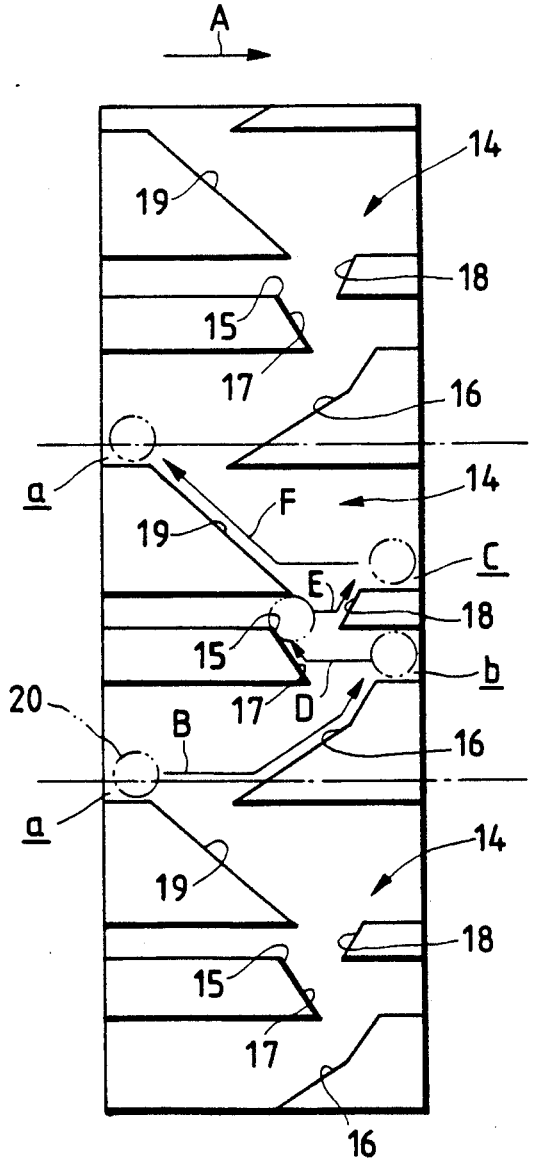
FIG. 4 is an exploded view of the cam groove of the rotor.

A cam groove 14 is provided in the outside circumferential surface of the rotor 11 along the total circumference thereof, and consists of three portions extending contiguously to each other as shown in FIG. 4 which is an exploded view of the outside circumferential surface of the rotor. Each of the cam groove portions 14 has a locking halfway part 15 and a first, second third and a fourth oblique parts 16, 17, 18 and 19. The insulator 2, which is not movable, has a locking projection 20 fitted in the cam groove of the rotor 11 so that the projection slides in the cam groove relative to the rotor as the rotor is moved rightward and leftward together with the contact holder 4.

The operation of the switch is described in detail hereinbelow. When the contact holder 4 is in the original position thereof as shown in FIG. 1, the locking projection 20 is in a position a at the left of the first oblique part 16 of one of the cam groove portions 14 as shown in FIG. 4 and the movable contact does not touch the fixed contact 3 so that the switching means 9 is off. When the manipulating portion 5 is pressed in a direction opposite the direction A, the contact holder 4 and the rotor 11 move with it against the force of the return spring 10 so that the locking projection 20 slides from the position a to position b through the first oblique part 16 of the cam groove portion 14 relative to the rotor, as shown by an arrow B in FIG. 4, while rotating the rotor 11 in a direction C as shown in FIG. 3.

When the pressing of the manipulating portion 5 is ceased, the contact holder 4 and the rotor 11 are moved in the direction A by the force of the return spring 10 and the locking projection 20 slides relative to the rotor along the second oblique part 17 of the cam groove portion 14 as shown by an arrow D, so that the locking projection becomes engaged into the halfway locking part 15 of the cam groove portion while slightly rotating the rotor in the direction C. Because of the engagement, the contact holder 4 is locked in the pressed-in position. At that time, the movable contact 7 is put touches the fixed contact 3 so that the switching means is 9 turns on.

When the manipulating portion 5 is thereafter pressed again in the direction opposite the direction A, the contact holder 4 and the rotor 11 move with it so that the locking projection 20 slides relative to the rotor from the position b to position c through the third oblique part 18 of the cam groove portion 14 as shown by an arrow E in FIG. 4, while slightly rotating the rotor 11 in the direction C.

When the pressing of the manipulating portion 5 is then ceased, the contact holder 4 and the rotor 11 are moved in the direction A so that the locking projection 20 slides relative to the rotor from the position c to the position a in the next adjacent cam groove portion 14 along the fourth oblique part 19 of the current cam groove portion 14 as shown by an arrow F in FIG. 4, while rotating the rotor 11 in the Direction C. At that time, the contact holder 4 is put into the original position as shown in FIG. 1, and the movable contact 7 does not touch with the fixed contact 3 so that the switching means 9 turns off again. As can be seen from FIG. 4, because the groove consists of 3 similar portions, the off-on-off cycle just described entails a 120° (360°/3) rotation of the rotor. The rotor 11 is thus rotated at every pressing of the manipulating portion 5, so that the contact holder 4 is locked in the pressed-in position or unlocked out of the position and the switching means 9 turns on and off.

Since the locking mechanism is constituted by the rotor 11 having the cam groove 14 and the locking projection 20, and the locking projection 20 is slidable relative to the cam groove 14 according to the switch of the present invention described above, the locking projection 20 does not need to be biased toward the cam groove of the rotor, unlike the conventional switch in which the locking mechanism is constituted by the heart-shaped cam groove and the locking pin which needs to be biased toward the cam groove. For that reason, sliding resistance the locking projection 20 in the cam groove is reduced, thereby improving the manipulating property of the switch. Further, because this biasing is not required and the bottom of the groove is smooth, the collision noise of the prior art is not generated by the locking projection in the groove.

Although in the first embodiment the boss 13 is provided on the rotor 11 and rotatably fitted in the notch 12*a* of the chamber 12 to rotatably support the rotor, the rotor need not be provided with the boss and can be rotatably supported by the inside surface of the chamber and that of the casing 1.

Figure 5:
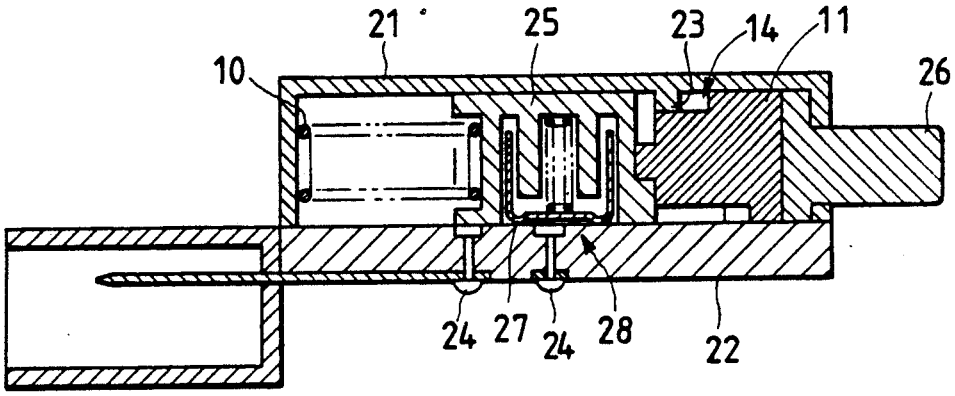
FIG. 5 is a longitudinally sectional view of the switch of a second embodiment of the present invention with the contact holder in the original position.

FIG. 5 shows a switch which is a second embodiment of the invention. The difference of the switch from that of the first embodiment is that the switch shown in FIG. 5 includes a casing 21 open at the bottom thereof, an electric insulator 22 attached to the casing and closing the bottom thereof, and a locking projection 23 provided on the inside surface of the upper portion of the casing and fitted in the cam groove 14 of a rotor 11. The switch also includes a pair of fixed contacts 24, a contact holder 25, a manipulating portion 26, a substantially U-shaped movable contact 27, and a switching means 28 constituted by the fixed and the movable contacts. The switch operates in the same manner as the preceding switch of the first embodiment shown in FIGS. 1 to 4, and therefore, produces the same effect as the preceding switch.

Figure 6:
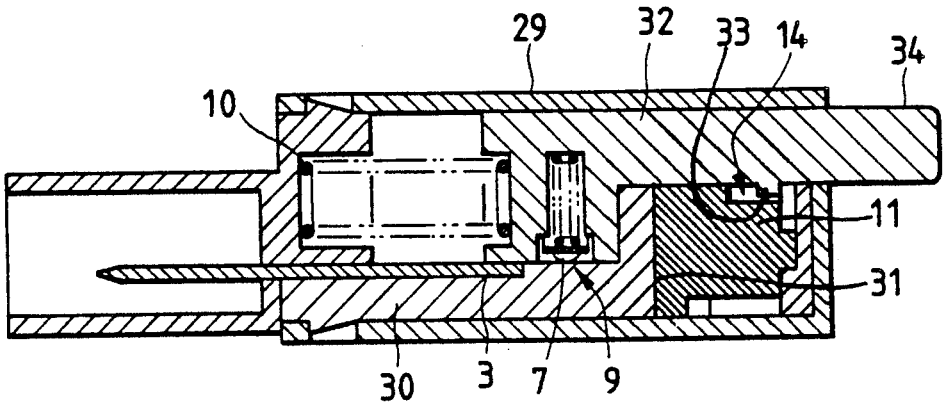
FIG. 6 is a longitudinally sectional view of the switch of a third embodiment of the present invention in the state that contact holder is in the pressed in position.

FIG. 6 shows a switch which is a third embodiment of the invention. The difference of the switch from that of the first embodiment is that the switch shown in FIG.

6 includes a casing 29, an unmovable electric insulator 30 attached to the casing and provided with a chamber 31 in which a rotor 11 is rotatably supported, and a movable contact holder 32 provided with a locking projection 33 fitted in the cam groove 14 of the rotor. The switch also includes a manipulating portion 34 provided on the contact holder 32 integrally therewith. The switch operates in the same manner as that of the first and second embodiments. Therefore, the switch produces the same effect as that of the preceding embodiments.

The present invention is not limited to the above-described embodiments, but may be embodied or practiced in other various ways without departing from the spirit or essential character thereof. For example, pins or the like may be provided instead of the locking projections 20, 23 and 33.

A switch provided in accordance with the present invention is characterized in that a rotor provided with a cam groove in the outside circumferential surface of the rotor and supported rotatably, and a locking projection fitted in the cam groove constitute a locking mechanism. The locking projection does not need to be biased to the cam groove but slidable therein relative to the rotor, as differs from the conventional switch in which the locking mechanism is constituted by the heart-shaped cam groove and the locking pin which needs to be biased toward the cam groove. For that reason, the resistance to the sliding of the locking projection in the cam groove of the rotor of the switch provided in accordance with the present invention can is reduced, thereby improving the manipulating property of the switch. Since the locking projection does not need to be biased to the cam groove and the bottom of the groove is smooth, the collision noise of the prior art is not generated by the locking projection in the cam groove.

What is claimed is:

1. A locking assembly suitable for use in a switch mechanism having a first contact and a second contact, comprising:

a casing including means for coupling to the second contact;

means for holding the first contact, the holding means and the casing together defining a chamber in the casing, and being unrotatably disposed in the casing to be slidable in a longitudinal axis of the casing allowing selective contact between the first and second contacts;

means for biasing the holding means toward a first position;

a rotor, rotatably provided in the chamber in the casing on an axis parallel with the longitudinal axis of the casing, and having a groove on an outer periphery, the groove having a plurality of oblique portions and a locking part; and a locking means extending into the groove of the rotor in a direction orthogonal to the axis of the rotor, the locking means being disposed to slide relative to the rotor along the oblique portions in accordance with movement of the holding means, thereby rotating the rotor, wherein when the holding means is pressed from a first position, the rotor rotates such that upon release from pressing the holding means is moved by the biasing means and the locking means engages with the locking part of the rotor to maintain the holding means in a second position, and when the holding means is pressed from the second position, the locking means disengages from the locking part of the rotor while rotating the rotor such that upon release from pressing the holding means is moved to the first position by the biasing means.

2. The switch of claim 1, in which the holding means further comprises a manipulating portion disposed in the casing.

3. The switch of claim 2, wherein said manipulating portion abuts said rotor.

4. The switch of claim 2, wherein said manipulating portion and said holding means are unitary formed.

5. The assembly of claim 4, wherein the locking means is provided on the holding means.

6. The assembly of claim 5, wherein the rotor includes a boss, and the casing includes means for rotatably engaging the boss.

7. The switch of claim 1, wherein that portion of the casing touching the second contact includes an insulating member.

8. The switch of claim 7, wherein said locking means is provided on said insulating member.

9. The switch of claim 1, wherein said locking member is provided on an inner wall of said casing.

10. The switch of claim 5, 8 or 9, wherein said locking means is a projection.

11. The switch of claim 5, 8 or 9, wherein said locking means is a pin.

12. The switch of claim 8 or 9, wherein said rotor includes a boss, and the holding means includes means for rotatably engaging the boss.

13. The switch of claim 1 wherein the rotor is formed with a boss, and the holding means includes means for engaging the boss and means for allowing selective contact between the first and second contacts in a direction orthogonal to the longitudinal axis.

14. A locking assembly suitable for use in a switch mechanism having a first contact and a second contact, comprising:

a casing including means for coupling to the second contact, the means for coupling including an insulating member;

means for holding the first contact, the holding means and the casing together defining a chamber in the casing, and being unrotatably disposed in the casing to be slidable in a longitudinal axis of the casing allowing selective contact between the first and second contacts;

means for biasing the holding means toward a first position;

a rotor, rotatably provided in the chamber in the casing on an axis parallel with the longitudinal axis of the casing, and having a boss and having a groove on an outer periphery, the groove having a plurality of oblique portions and a locking part; and a locking means extending into the groove of the rotor in a direction orthogonal to the axis of the rotor, the locking means being disposed to slide relative to the rotor along the oblique portions in accordance with movement of the holding means, thereby rotating the rotor, wherein when the holding means includes means for rotatably engaging the boss and wherein when the holding means is pressed from a first position, the rotor rotates such that upon release from pressing the holding means is moved by the biasing means and the locking means engages with the locking part of the rotor to maintain the holding means in a second position, and when the holding means is pressed from the second position, the locking means disengages from the locking part of the rotor while rotating the rotor such that upon release from pressing the holding means is moved to the first position by the biasing means.

15. A locking assembly suitable for use in a switch mechanism having a first contact and a second contact, comprising:

a casing including an inner wall and means for coupling to the second contact;

means for holding the first contact, the holding means and the casing together defining a chamber in the casing, and being unrotatably disposed in the casing to be slidable in a longitudinal axis of the casing allowing selective contact between the first and second contacts;

means for biasing the holding means toward a first position;

a rotor, rotatably provided in the chamber in the casing on an axis parallel with the longitudinal axis of the casing, and having a boss and having a groove on an outer periphery, the groove having a plurality of oblique portions and a locking part; and a locking means coupled to the inner wall of the casing and extending into the groove of the rotor in a direction orthogonal to the axis of the rotor, the locking means being disposed to slide relative to the rotor along the oblique portions in accordance with movement of the holding means, thereby rotating the rotor, wherein when the holding means includes means for rotatably engaging the boss and wherein when the holding means is pressed from a first position, the rotor rotates such that upon release from pressing the holding means is moved by the biasing means and the locking means engages with the locking part of the rotor to maintain the holding means in a second position, and when the holding means is pressed from the second position, the locking means disengages from the locking part of the rotor while rotating the rotor such that upon release from pressing the holding means is moved to the first position by the biasing means.

16. A locking assembly suitable for use in a switch mechanism having a first contact and a second contact, comprising:

a casing including means for coupling to the second contact;

means for holding the first contact, the holding means and the casing together defining a chamber in the casing, and being unrotatably disposed in the casing to be slidable in a longitudinal axis of the casing allowing selective contact between the first and second contacts including means for allowing selective contact between the first and second contacts in a direction orthogonal to the longitudinal axis;

means for biasing the holding means toward a first position;

a rotor, rotatably provided in the chamber in the casing on an axis parallel with the longitudinal axis of the casing, and having a groove on an outer periphery, the groove having a plurality of oblique portions and a locking part, the rotor including a boss; and a locking means extending into the groove of the rotor in a direction orthogonal to the axis of the rotor, the locking means being disposed to slide relative to the rotor along the oblique portions in accordance with movement of the holding means, thereby rotating the rotor, wherein when the holding means includes means for engaging the boss and wherein when the holding means is pressed from a first position, the rotor rotates such that upon release from pressing the holding means is moved by the biasing means and the locking means engages with the locking part of the rotor to maintain the holding means in a second position, and when the holding means is pressed from the second position, the locking means disengages from the locking part of the rotor while rotating the rotor such that upon release from pressing the holding means is moved to the first position by the biasing means.

* * * * *